United States Patent [19]

Braun

[11] Patent Number: 5,052,056

[45] Date of Patent: Oct. 1, 1991

[54] INTERCHANGEABLE CREST SWEATSHIRT

[76] Inventor: Andrew Braun, 20 Cherrytree Drive, Apt. 704, Brampton, Ontario, Canada, L6Y 3V1

[21] Appl. No.: 544,952

[22] Filed: Jun. 28, 1990

[51] Int. Cl.[5] ..... A41B 1/00

[52] U.S. Cl. ..... 2/115; 2/244; 2/246; 2/DIG. 6

[58] Field of Search ..... 2/115, 244, 246, DIG. 6

[56] References Cited

U.S. PATENT DOCUMENTS

| | | | |
|---|---|---|---|
| 3,484,974 | 12/1969 | Culmone | 2/115 |
| 4,249,268 | 2/1981 | Berler | 2/115 |
| 4,277,848 | 7/1981 | Boehland | 2/115 |
| 4,354,282 | 10/1982 | Langdon | 2/115 |
| 4,513,454 | 4/1985 | Anderson et al. | 2/246 |
| 4,611,355 | 9/1986 | Galanto et al. | 2/246 |
| 4,627,110 | 12/1986 | Tengs | 2/115 |
| 4,710,981 | 12/1987 | Sanchez | 2/115 |
| 4,776,043 | 11/1988 | Coleman | 2/DIG. 6 |
| 4,873,726 | 10/1989 | Tapia | 2/DIG. 6 |

*Primary Examiner*—Werner H. Schroeder
*Assistant Examiner*—Gloria Hale

[57] ABSTRACT

A sweatshirt to be worn to a sports game comprising: a first crest including home team indicia silk screened to the exterior of the sweatshirt; loop structure having a circular configuration with a first diameter associated exteriorly to the sweatshirt; a second crest having indicia of a competitor's team on one side thereof, and hook structure having a circular configuration with a diameter corresponding to the first diameter whereby the second crest is releasibly securable exteriorly to the sweatshirt by fastening the loop structure to the hook structure; and a strip adapted to overlie the crest.

8 Claims, 3 Drawing Sheets

INTERCHANGEABLE CREST SWEATSHIRT

FIELD OF INVENTION

This invention relates to a sweatshirt adapted to be worn to a sports game and particularly relates to a sweatshirt having a fixed home team crest presented by said sweatshirt and a releasibly removable crest of a competitor's team.

BACKGROUND TO THE INVENTION

Various garments have heretofore been proposed which include various indicia including sports team crests which may be releasibly secured therefrom.

For example, U.S. Pat. No. 3,489,974 teaches a removable identifying means comprising in combination an elongated strip having a plurality of loop elements on its outer surface and a plurality of characters, each comprised of material having a plurality of resiliently deformed hook shaped elements on its rear surface. Each of the characters is adapted to be removably attached to the strip so that various combinations of the characters may be used interchangeably with the strip.

Moreover U.S. Pat. No. 4,354,282 illustrates a garment to be worn on a body torso while playing a sports game. The garment includes a front panel for support from and positioning in overlying relationship to the crest area of a person wearing the garment and further includes indicia associated with each distinctive colour area with the indicia indicating the score values of successive scores of predetermined sports games. At least one marker of another distinctive colour is provided and selectively registerable over the distinctive colour areas.

Furthermore U.S. Pat. No. 4,666,136 relates to a T-Shirt on which a graphical representation comprises a portion imprinted on the T-Shirt with a 3-dimensional self-supporting structure temporarily connected to the T-Shirt completing the design.

Yet another garment is disclosed in U.S. Pat. No. 4,627,110 which relates to an article of wearing apparel such as a shirt which has a writing surface provided on a prominent portion thereof when worn by a user.

Finally, U.S. Pat. No. 4,710,981 teaches a wearing apparel consisting of a garment which includes a flap with a releasible gripping surface hinged on one of the garment's exposed surface panels and constructed so that the end of the flap which is not hingedly connected can be swung away from the garment panel to flash or expose a written indicia on the underside of the flap.

It is an object of this invention to provide an improved garment which includes a fixed home team crest and a releasibly securable crest of a competitor.

It is an aspect of the invention to provide an article of clothing including: a first crest of a sports team silk screened exteriorally to the article; a second crest of a sports team releasably securable exteriorally to the article, said second crest being a competitor of said first crest; first attachment structure having a circular configuration associated with said article; a second attachment structure having a circular configuration associated with said second crest so as to releasably secure said second crest to said article when said second attachment structure overlies said first attachment structure; and a circle silk screened to said article having a diameter greater than said first attachment structure and adjacent thereto.

It is a further aspect of this invention to provide a sweatshirt adapted to be worn to a sports game comprising: a first crest, including home team indicia silk screened to the exterior of said sweatshirt; a second crest having a circular configuration with a first diameter including: indicia of a competitor's team on one side thereof, and hook structure presented along the peripheral edge of the other side thereof; loop structure fixedly secured to said article in a circular configuration with the same diameter as said second crest; said second crest releasably securable exteriorally to said sweatshirt by releasably fastening said loop structure to said hook structure; and a strip providing hook structure at the ends thereof; said strip adapted to overlie said second crest with said hook structure fastening said strip to said second crest.

It is yet another aspect of this invention to provide a sweatshirt adapted to be worn to a sports game comprising: a first crest including home team indicia silk screened to the exterior of said sweat shirt; a second crest having a parametral edge including: indicia of a competitor's team on one side thereof; and a hook presented along the peripheral edge of the other side thereof; a loop fixedly secured to said article and having a configuration co-extensive with said second crest; said second crest releasably securable exteriorally to said sweatshirt by releasably fastening said hook to said loop whereby only said hook presented along the peripheral edge of said second crest is releasably secured to said loop whereas the remainder of said second crest is releasable from said article so as to define a pocket therein.

DESCRIPTION OF THE DRAWINGS

These and other objects and features shall now be described in relation to the following drawings.

DESCRIPTION OF THE INVENTION

Like parts have been given like numbers throughout the figures.

Figure 1:
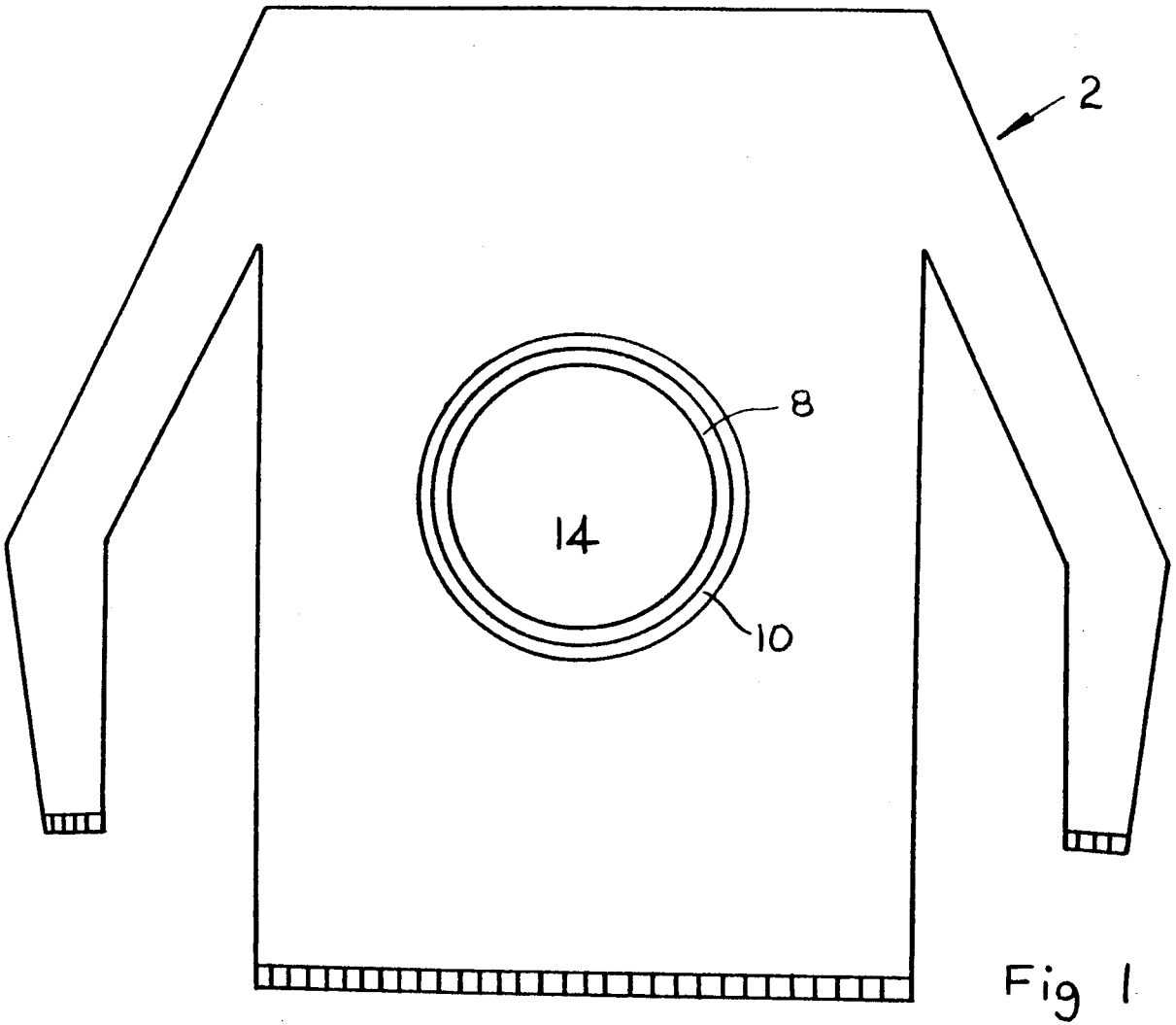
In FIG. 1 is a top plan view of a sweatshirt.

FIG. 1 generally discloses a garment 2 such as a sweatshirt or the like adapted to be worn by a user. The sweatshirt is comprises of terrycloth material such as cotton/polyester knit or the like or other material well known to those persons skilled in the art.

Figure 4:
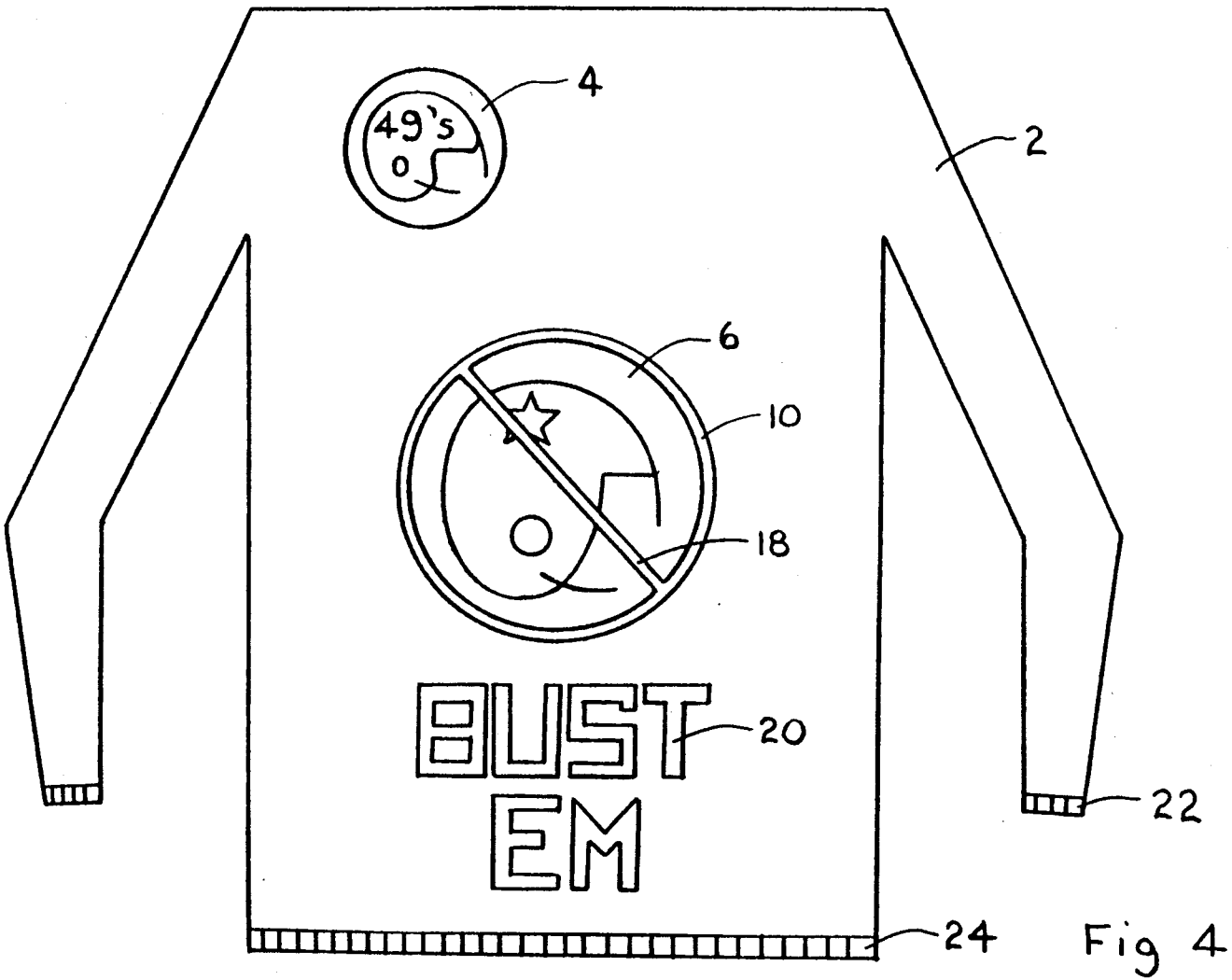
FIG. 4 is a top plan view of the sweatshirt with the component parts assembled thereon.

A sweatshirt 2 includes first indicia 4 best illustrated in FIG. 4. In particular first indicia 4 comprises a first crest which in the invention as described herein comprises a home team emblem which is fixedly secured to the sweatshirt 2. In the embodiment described herein the home team emblem 4 is silk screened on to the exterior surface of sweatshirt 2.

The sweatshirt 2 also includes second indicia 6 which comprises of a competitor's team crest or visitor's crest which is adapted to be releasibly removed and secured to the sweatshirt 2 in a manner which shall be more fully described herein.

The sweatshirt 2 as shown in FIG. 1 includes loop structure or elements 8 presented in a circular structure. More particularly the loop structure or element 8 comprises the loop structure of material sold under the Trade Mark "Velcro". The loop structure 8 is associated with the exterior surface of the sweatshirt 2 and can be stitched or sew thereto.

The sweatshirt 2 also includes a circle 10 which is silk screened to the exterior surface of sweatshirt 2 in such a manner so as to be concentric with the loop structure 8 and adjacent or contiguous thereto.

Figure 2:
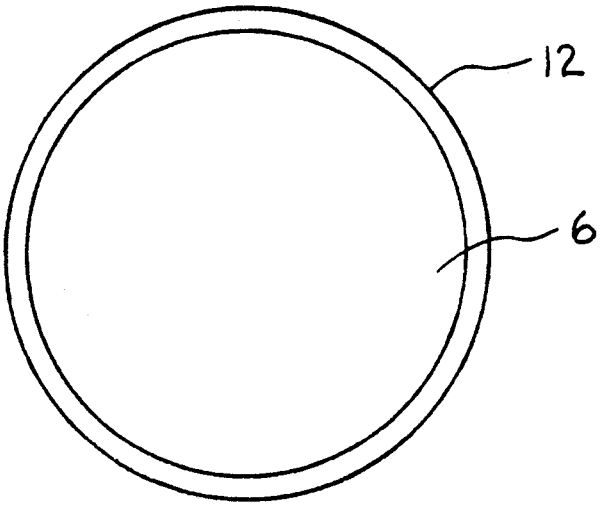
FIG. 2 is a top plan view of the underside surface of the removable crest.
Figure 3:
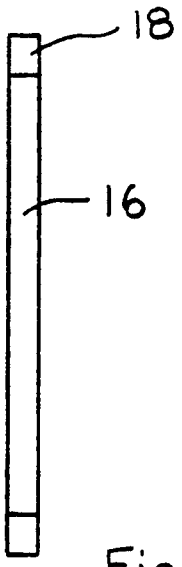
FIG. 3 is a side elevational view of the strip.

The second crest 6 includes indicia on one side thereof as shown in FIG. 4 and includes on the other side thereof as shown in FIG. 2 hook structure or elements 12 associated with the underside of crest 6. In particular the hook structure 12 comprises of the other element of material which is sold under the Trade Mark "Velcro" and which is associated therewith either by being stitched thereto or other suitable means.

Accordingly when the wearer of the sweatshirt 2 attends a game against the wearer's home team the wearer will select the crest 6 which corresponds to the team which is visiting or competing with the home team. Once the appropriate crest 6 is selected the crest is releasibly secured to sweatshirt 2 by placing the hook structure 12 of crest 6 to be releasibly secured to the loop structure 8.

It should be noted that the crest 6 when attached to garment 2 presents a pocket 14 between garment 2 and crest 6 which may be utilized to receive tickets, money or the like. In particular the hook structure or second attachment means 12 is presented only along the peripheral edge of the crest 6. The crest 6 has a circular configuration. In other words, the hook means 12 also has a circular configuration like a donut, and is adapted to b releasably secured to the loop structure 8; so that the remainder of the back side of the crest 6 is free to be moved away from the sweatshirt so as to define a pocket therein.

Moreover a strip 16 may be utilized whereby the ends of strip 16 include hook structure 18 such that the strip 16 may be placed over the second crest 6 as best shown in FIG. 4 so that the ends 18 terminate at circle 10.

The sweatshirt 2 may also include wording 20.

The sweatshirt 2 also includes elastic wrist 22 and waistband 24.

It should be noted that the wearer of the sweatshirt 2 can include crests of various teams such as, for example, N.F.L. teams' crests which may be adapted to be placed on a wall as collection.

Although the invention has been described so as to show the first and second indicia on the front of a sweatshirt, such indicia may be located on the back of the sweatshirt so as to provide more room on the front for wording 20.

It should be noted that the user may also wear a cap or hat (which is not shown) which hat may also include the hook structure 8 so as to receive a second crest 6 and strip 16 in the manner as described above.

While the salient features of the invention have been illustrated and described, it should be readily apparent to those skilled in the art that changes and modification can be made in the invention presented without departing from the spirit and true scope of the invention. Accordingly, the present invention should be considered as encompassing all such changes and modifications that are within the broad scope of the invention as described in the appended claims.

The embodiments of the invention in which an exclusive property or privilege is claimed are defined as follows:

1. An article of clothing including:

(a) a first crest of a sports team silk screened exteriorally to said article;

(b) a second crest of a sports team releasably securable exteriorly to said article said second crest being a competitor of said first crest;

(c) first attachment means having a circular configuration associated with said article;

(d) second attachment means having a circular configuration associated with said second crest so as to releasably secure said second crest to said article when said second attachment means overlies said first attachment means.

(e) a circle silk screened to said article having a diameter greater than said first attachment means and adjacent thereto.

2. An article of clothing as claimed in claim 1 wherein said first attachment means comprises loop means and second attachment means comprises hook means.

3. An article of clothing as claimed in claim 1 wherein said first attachment means comprises hook means and said second attachment means comprises loop means.

4. An article of clothing as claimed in claim 2 including a strip with two ends having hook means at the ends thereof, said strip to overlie said second crest means with the ends thereof terminating at and attachable to said circle silk screened to said article.

5. In a sweatshirt to be worn to a sports game comprising:

(a) a first crest including home team indicia silk screened to the exterior of said sweatshirt;

(c) loop means fixedly secured to said article in a circular configuration with the same diameter as said second crest;

(b) a second crest having a circular configuration with a first diameter including:

(i) indicia of a competitors team on one side thereof; and (ii) hook means presented along the peripheral edge on the other side thereof;

(d) said second crest releasably securable exteriorly to said sweatshirt by releasably fastening said loop means to said hook means;

(e) a strip with two ends having hook means at the ends thereof, said strip, to overlie said second crest means with said hook means fastening said strip means to said second crest means.

6. In a sweatshirt as claimed in claim 5 further including a circle silk screened to said article having a diameter greater than said loop means and adjacent thereto.

7. In a sweatshirt adapted to be worn to a sports game comprising:

(a) a first crest including home team indicia silk screened to the exterior of said sweat shirt;

(b) a second crest having a parametral edge including:

(i) indicia of a competitor's team on one side thereof; and (ii) hook means presented along the peripheral edge on the other side thereof;

(c) loop means fixedly secured to said article and having a configuration coextensive with said second crest;

(d) said second crest releasably securable exteriorally to said sweatshirt by releasably fastening said hook means to said loop means whereby only said hook means presented along the peripheral edge of said second crest is releasably secured to said loop means whereas the remainder of said second crest is releasable from said article so as to define a pocket therein.

8. In a sweatshirt as claimed in claim 7 wherein said parametral edge defines a circular configuration.

* * * * *